US005143777A

United States Patent [19]

Mills

[11] Patent Number: 5,143,777

[45] Date of Patent: Sep. 1, 1992

[54] CERAMIC MOULD MATERIAL

[75] Inventor: David Mills, Bristol, England

[73] Assignee: Rolls-Royce plc, London, England

[21] Appl. No.: 518,431

[22] Filed: May 3, 1990

[30] Foreign Application Priority Data

May 20, 1989 [GB] United Kingdom ..... 8911666

[51] Int. Cl.[5] ..... S32B 5/16

[52] U.S. Cl. ..... 428/212; 428/329; 428/325; 428/331; 106/38.3; 106/605

[58] Field of Search ..... 106/38.3, 6.75, 605; 501/153, 81; 428/212

[56] References Cited

U.S. PATENT DOCUMENTS

| | | | |
|---|---|---|---|
| 2,553,759 | 5/1951 | Geiger et al. | 106/409 |
| 3,923,534 | 12/1975 | Cassidy | 501/111 |
| 3,943,009 | 3/1976 | Hipp | 501/31 |
| 3,944,425 | 3/1976 | Magder | 501/84 |
| 4,186,222 | 1/1980 | Sellars et al. . | |
| 4,432,799 | 2/1984 | Salazar | 106/675 |
| 4,664,172 | 5/1987 | Takayanagi | 164/34 |

FOREIGN PATENT DOCUMENTS 1112882 5/1968 United Kingdom .

OTHER PUBLICATIONS

Rhinalox ® Bubble Aluming, Technical Bulletin from Hermann C. Starck, Berlin.

Abstract #136657b, Chemical Abstracts, vol. 102, No. 16; Apr. 1985, p. 294, (Mitsubishi Heavy Industries Ltd.).

*Primary Examiner*—William R. Dixon, Jr.
*Assistant Examiner*—Margaret V. Einsmann
*Attorney, Agent, or Firm*—Oliff & Berridge

[57] ABSTRACT

A ceramic material for making ceramic moulds and core for metal casting is described comprising basically granular or bubble refractory material, e.g. alumina or mullite, bound together by hardened ceramic slurry. Moulds for lost wax casting are built-up by dipping a wax pattern in ceramic slurry and then applying granules of bubble alumina in an all over coating. A plurality of such coats may be applied by allowing the slurry to harden between applications. The moulds are more insulating than those using tubular alumina grits, for example, and produce castings with smoother surface finishes.

6 Claims, 3 Drawing Sheets

CERAMIC MOULD MATERIAL

Figure 1:
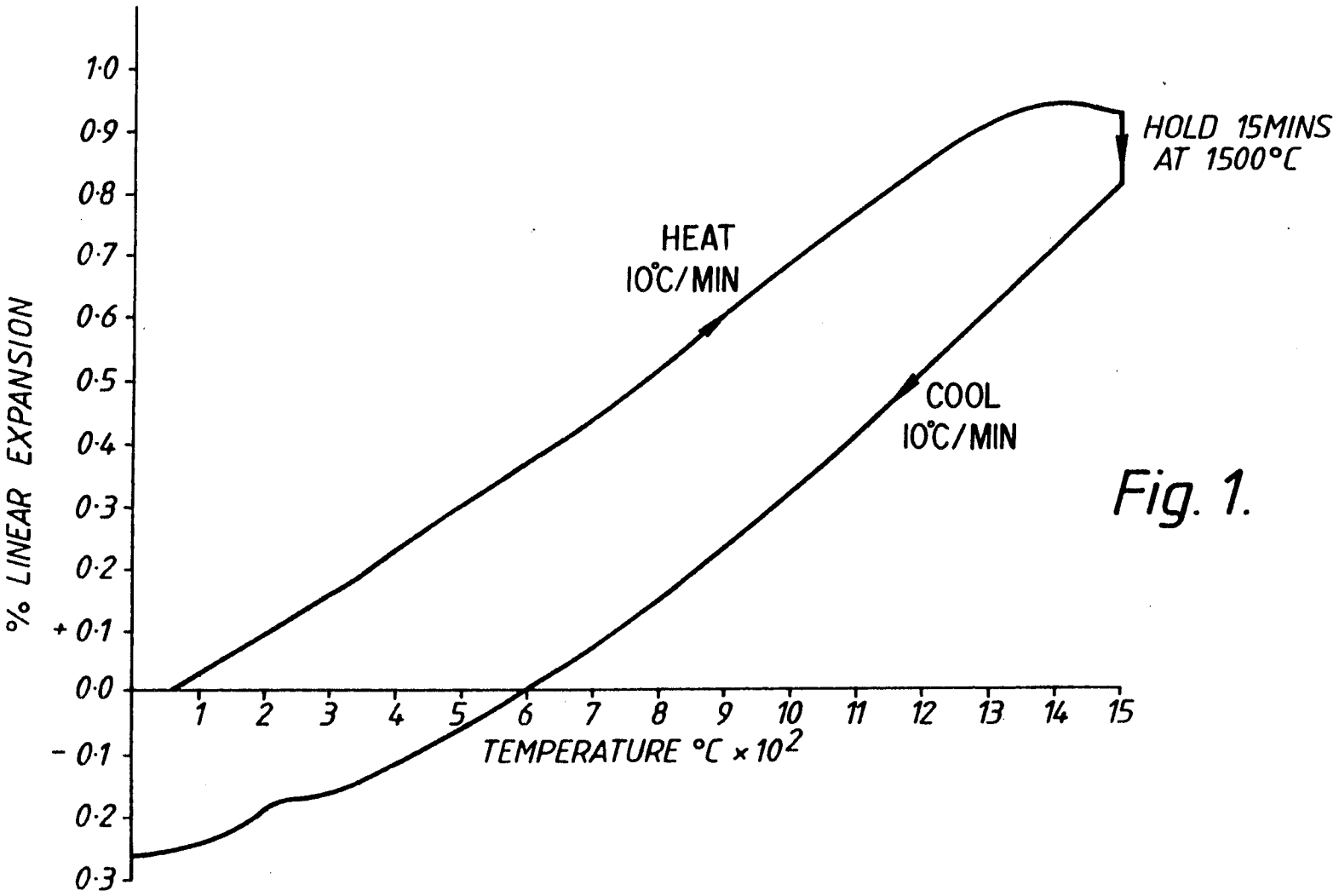

The invention relates to improvements to ceramic moulds. In particular it concerns the materials used to make the moulds and methods of producing the moulds.

In the manufacture of moulds for investment casting of metals, the mould shell is built up around a wax pattern by dipping it into a slurry of ceramic material and stuccoing or raining coarse refractory grit onto the wet slurry. The wet slurry coat may be dried or hardened and the above procedure repeated several times to build up a coating of sufficient thickness, for mould strength and integrity, before the green mould is fired.

Several refractory materials, such as fused silica, fused alumina, tabular alumina and fused or sintered alumina silicates are used as stucco materials. They are produced by bulk fusion or sintering and are then crushed and sieved to separate-out grits of required sizes. Purified and graded natural sands, for example zirconium silicate and quartz sands are sometimes also used. Characteristically these materials consist of particles which are angular in shape with a tendency to have sharp edges and corners and a degree of uneven packing occurs in the stuccoed layers. These stucco grits preground more finely to provide a flour of suitable particle size distribution are usually used for slurry fillers.

In multi-layered moulds the first or prime coat slurry, because it forms the internal surface of the mould in contact with the cast metal, usually has a higher viscosity than subsequent coats and the stucco refractory grit is of finer particle size so as to produce as smooth a cast surface as possible. Subsequent coats are produced using coarser grit sizes and lower viscosity slurries.

Moulds need to be dimensionally stable, inert, and to have good thermal shock characteristics depending on the type of alloy being cast, the geometry of the cast article and the nature of the metallurgical structure. In equiaxed casting, where molten alloy is poured into preheated moulds and allowed to solidify relatively quickly, mould surface temperatures may reach around 1300° C. maximum for short periods of time. In directionally solidified and single crystal alloy casting the mould is heated above the alloy melting point so that the casting may be progressively solidified over a relatively longer period of time. Thus, a mould must be dimensionally stable and able to withstand temperatures of up to around 1650° C. Without adequate refractoriness a mould or mould system can distort during the pouring and solidification stages leading to poor control of casting dimensions.

Good casting surface finish is also required and for this a smooth surface of the prime coat is essential. If the initial slurry viscosity is unsuitable, or the wax pattern is overdrained, the grits or sands in the prime coat stucco can penetrate the wet slurry coat too deeply causing an air pocket to form at or near the metal/mould interface leading to penetration of the cast metal into the mould surface, producing a rough casting surface. Even when a rough finish to the casting is desired the process by which it is produced must be controllable to achieve consistency.

Mould thickness consistency is also important for strength and predictable thermal behaviour. Mould shell strength must be sufficiently high to avoid mould failure on one hand and on the other hand it must be low enough, and the shell sufficiently crushable, to avoid stressing tearing or cracking of the solidifying casting and to facilitate easy shell removal.

In equiaxed casting a mould must also exhibit good thermal characteristics to ensure it is at and maintains the correct temperature when molten metal is poured. A temperature which is too low, particularly for castings with thin sections can cause premature chilling of the metal and local variations in mould temperature resulting in variable solidification rates which can produce undesirable metallurgical structures in the finished casting. To avoid this, for example, when casting thin section equiaxed turbine blades, moulds are usually wrapped in additional external insulation to maintain a correct mould temperature and avoid cooling before metal is poured if separate ovens are used to heat the moulds causing a delay.

Hollow cavities in cast articles are produced using preformed ceramic cores located within the mould cavity. Using for example the lost wax pattern process these cores are formed separately, fired and incorporated within the expendable pattern prior to building-up the external mould shell. These cores can be produced in a similar manner to external shell moulds but on the internal surfaces of a core die which can be split to remove a hardened "green" core. Other core forming methods used mainly involve casting and injection moulding. However, in common with the described shell building process these methods also use a hardenable liquid of flowable binder with a refractory grit or powder of suitable particle size.

Such internal cores also need high temperature stability, inertness and crushability. Simple core shapes can be removed by mechanical means but complex shapes may need to be leached from the casting. The latter requirement restricts the choice of usable materials principally to silica or alumina based ceramic compositions or the like.

The present invention has for its object to provide ceramic moulds which will overcome the problems and difficulties discussed above. In particular the invention is intended to produce moulds the shells of which are of very even thickness, and of consistently reproducible thickness; to produce moulds having good thermal insulating properties a high degree of dimensional stability, are easily removed after casting and where necessary possess good "crushability" but which are free, or largely free, of surface voids which could be penetrated by molten alloy and are thus able to produce good surface finishes.

In its most general form the invention provides a ceramic shell mould or core material comprising refractory material in bubble form.

According to one aspect of the invention a ceramic mould or core material for use in casting metals contains hollow grains or bubbles of refractory material bound together by a hardened ceramic slurry.

The hollow grains or bubbles of refractory material have a closed cell structure and comprises alumina, preferably, or mullite. The ceramic slurry consists of a liquid binder and powdered refractory material.

In a preferred form of the invention a ceramic shell mould for casting molten metal has a plurality of layers of bubble material bonded by hardened ceramic slurry. The viscosity of the wet ceramic slurry used to produce the first of said layers is relatively higher than the viscosity of the slurry used in subsequent layers.

A method of producing a ceramic shell mould of the kind already described involves coating a wax pattern of an article to be cast with said ceramic slurry and while it is still wet applying to said coating a layer of the hollow sphere or bubble refractory materials, and subsequently hardening the ceramic slurry to bind together the bubbles or spheres of refractory material. To produce shell moulds having a plurality of layers of said bubble or hollow sphere material the described process step is repeated an appropriate number of times. Preferably, the viscosity of the ceramic slurry used for the first layer is relatively higher than that used for the subsequent layers.

Figure 2:
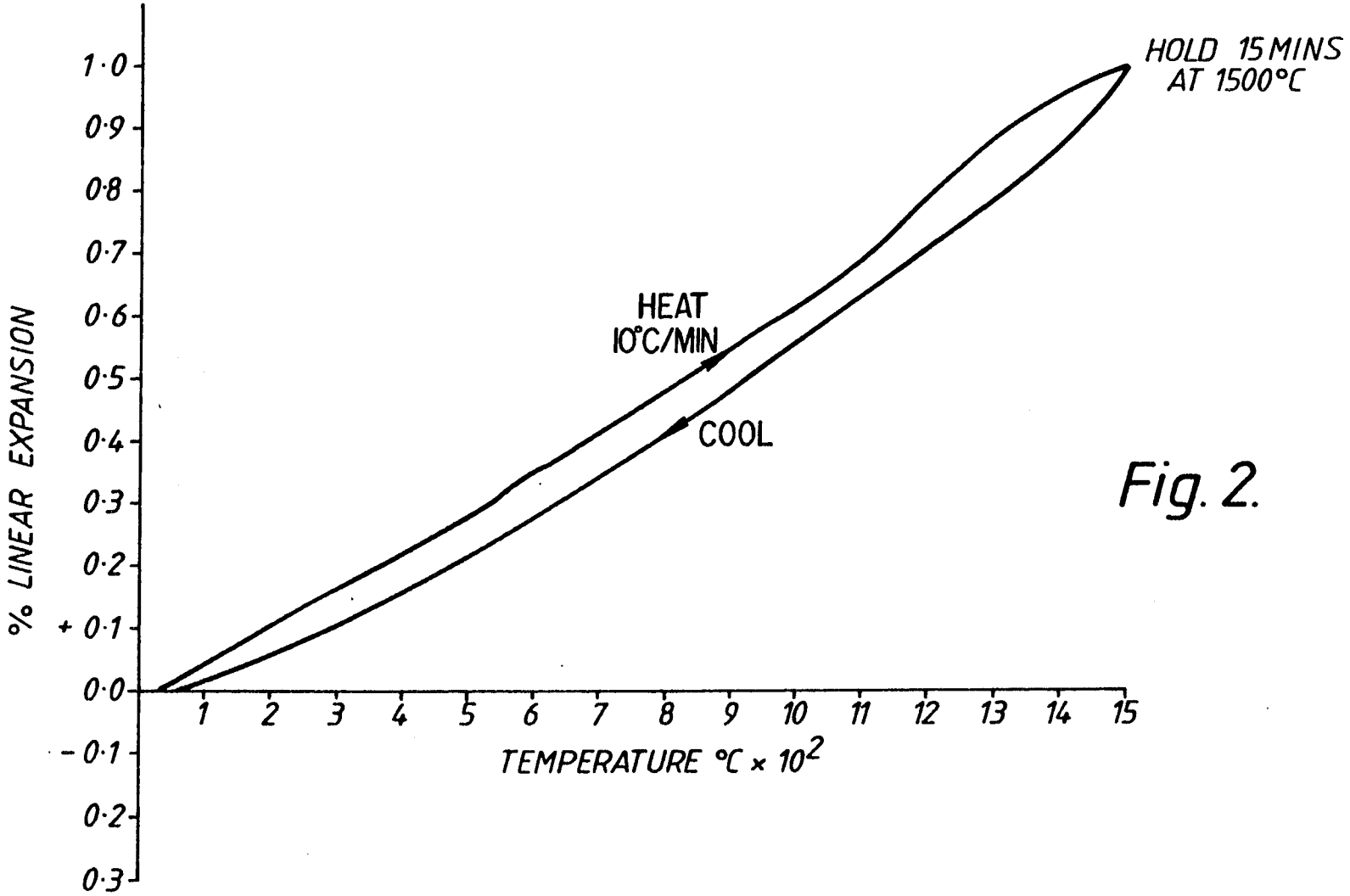
Figure 3:
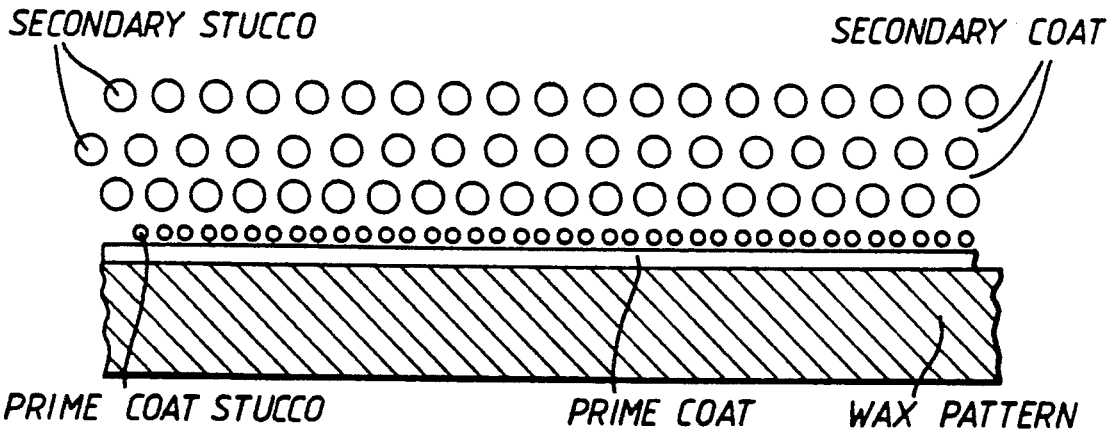

The invention will now be described in greater detail with reference to several examples by way of illustration, and with reference to the accompanying drawings in which:

FIG. 1 illustrates the thermal expansion characteristics of a known mould material, FIG. 2 illustrates the thermal expansion characteristics of mould material in accordance with the invention comprising bubbles of refractory material, and FIG. 3 shows in diagrammatic form a section through part of a mould.

EXAMPLE 1

Ceramic Shell Mould

A ceramic shell mould for a solid cast article, for example a turbine blade, without internal cavities or cores was built-up on a wax pattern assembly of the article by dipping it repeatedly into a ceramic slurry and applying stucco coatings of hollow grains of bubble alumina. The diagram of FIG. 3 shows a section through part of such a mould and indicates the composition of the constituent layers of the mould. The primary ceramic slurry composition, set out in more detail hereinafter, was more viscous than the slurry used for the multiple secondary coats and the particle size of the primary coating stucco was finer than the secondary coatings thereby providing a smoother finish to the internal surface of the mould.

The wax turbine blade pattern assembly was dipped into a vat containing the primary coat slurry and allowed to drain sufficiently to leave an even coating on the pattern. The primary coat stucco material of bubble alumina grains or hollow particles was then sprinkled over the still wet slurry coat, ensuring that the entire surface was covered. It was then left in air for one to two hours to dry.

After drying, seven additional secondary coats were applied by dipping the primary coated pattern into the secondary coating ceramic slurry, allowing it to drain and then applying the secondary coat stucco of larger size grains of bubble alumina. At each stage the coating slurry was left to harden by a three step process which consisted of air drying for one half hour, followed by ten minutes in an atmosphere of ammonia and then a further period of one half hour in air before the next dip. Finally, after the required number of layers had been applied, the shell was sealed by dipping in the secondary slurry mix and, without a further application of stucco material, allowing the shell to dry in air for roughly twelve hours.

When the ceramic shell mould was thoroughly dried the wax was removed in a steam autoclave. The dewaxed "green" ceramic mould was then fired in a gas oven at a temperature of 850° for one hour. The finished shell ready for casting weighed only two-thirds the weight of a more conventional mould produced using similar slurry composition and tabular alumina grits. Insulation tests also showed that the moulds produced using bubble alumina were relatively much more insulating as well as substantially lighter. Shells produced this way were also found to have good resistance to cracking. Tests carried out by filling the shells with isopropanol coloured with methylene blue dye revealed no cracks, and proved to be dimensionally stable, judged by measurement of the dimensions of cast components, while at the same time the moulds were easy to remove after casting.

A batch of shell moulds made in accordance with the above detailed method were tested in a directional solidification process. The mould was heated inside a vacuum furnace to a temperature of 1470° C. An alloy charge was then melted and the molten metal poured into the mould and progressively solidified over a period of ninety minutes, according to known directional solidification techniques. The mould proved easy to remove and the cast component showed good dimensional control. Also, the surface finish of the component was smooth with no metal penetration defects or rough casting surfaces.

However, the enhanced insulating properties possessed by moulds made in this way are not necessarily ideal for directional solidification and single crystal casting where a longer thermal time constant could make it more difficult to control progress of the crystal solidification front during the withdrawal/cooling stage. On the other hand these properties are found positively beneficial in equiaxed casting where it is desirable to retain heat in some parts of a mould to prevent premature solidification of, for example, extremities and thinner sections of the article.

Primary Coat Slurry

The ingredients of the primary coat slurry were as follows:

Binder - Aqueous colloidal silica solvent containing 30% w/w silica.

Filler - 200 mesh zirconium silicate flour at a nominal loading of 4.8 kg/liter of binder. plus Wetting agent at 10 ml/liter of binder, and Antifoam agent at 5 ml/liter of binder.

The viscosity of the slurry was adjusted to 30 seconds to empty the first 70 ml using a BS 3900 B5 flow cup.

Primary Coat Stucco

Bubble alumina having a particle size range 0.25 mm–0.50 mm diameter.

Secondary Coat Slurry

The ingredients of the secondary coat slurry were as follows:

Binder - Hydrolyzed ethyl silicate with isopropanol solvent containing 25% w/w silica.

Filler - 200 mesh zirconium silicate flour at a nominal loading of 3.6 liter of binder.

The viscosity of the slurry was adjusted to 40 seconds to completely empty a BS 3900 B4 flow cup.

Secondary Coat Stucco

Bubble alumina having a particle size range 0.50 mm–1.00 mm diameter.

EXAMPLE II

Dimension Test Specimens.

Test specimens of bubble alumina shell were prepared by the method described above in Example I. Rectangular wax coated strips of metal, measuring 110 mm × 23 mm × 2 mm where coated using the same slurry mixes as previously noted. After shell build up was completed and the specimens dried the edges of each specimen were ground away and to release two flat ceramic test pieces or strips. Similarly sized test pieces were also built up using tabular alumina grit, instead of bubble alumina, for back-to-back testing.

Thermal expansion tests were carried out in air. The test pieces were heated at a rate of 10° C./minute from room temperature 20° C. to 1500° C., then held for 15 minutes dwell time at substantially constant maximum temperature 1500° C., and afterwards allowed to cool at a rate of 10°/minute. The measurement results for each of the two types of test pieces are illustrated graphically in FIGS. 1 and 2 of the accompanying drawings.

A prolonged dwell approximately 15 minutes at the maximum temperature is preferred as a means of revealing the dimensional stability of the shell material at high temperature. As will be seen from comparison of the results, the bubble alumina shell material exhibits excellent stability throughout the whole temperature range, but the tabular alumina shell starts to sinter at 1450° C. and shrinks during the dwell at 1500°. Whereas a mould made using tabular alumina material would shrink substantially on cooling, a similar mould made using bubble alumina would shrink very little on cooling thereby subjecting a casting to much lower stresses.

EXAMPLE III

Ceramic Core Material.

A ceramic material of similar type to that described in Example I for use as core material comprises the following ingredients:

Binder - Low viscosity polyester resin having a viscosity of 250 centistokes at 20° C. containing a peroxide catalyst and cobalt naphenate accelerator. This mixture has a cure time of approximately 10 minutes.

Filler - A powder blend containing 200 mesh fused alumina flour, and bubble alumina having nominal particle size range 0–0.25 mm mixed in the ratio of powder to bubble alumina of 30:70 by weight.

The liquid binder and blended filler were mixed in the ratio of filler to binder of 4.5:1 by weight. The resulting slurry was then introduced into the cavity of a core die by gravity feeding gently assisted by vibration, and allowed to cold cure to full hardness. The hardened "green" core, after being stripped from the die was then fired in a furnace in air using the following heating cycle:

20° C.–180° C. at a rate of 10° C./minute
180° C.–450° C. at a rate of 2° C./minute
450° C.–1550° C. at a rate of 10° C./minute The temperature of the furnace was then held at 1550° C. for four hours before being allowed to cool.

Cores made in this way will be found to be dimensionally stable and to possess an excellent smooth surface finish with high refractoriness. In addition the cores may be easily removed post-casting by chemical leaching in accordance with the techniques described in British Patent Nos. GB2,126,569B and GB2,126,931B.

The basis of the leaching technique described in these patents is the provision in the substance of the core of a quantity of hydrogen which it was found greatly enhanced the leachability of ceramic cores by anhydrous caustic salts. In the context of the present invention the hydrogen donor may be provided by the gases trapped within the alumina bubbles during their formation. This atmosphere may be controlled or adjusted to vary the leachablility of the final core.

I claim:

1. Ceramic mould material for use in equiaxed casting of metals and stable up to 1500° C., the material comprising a first layer comprising a hardened ceramic slurry and a bubble material selected from the group consisting of alumina and mullite and at least one additional layer comprising a hardened slurry and a bubble material selected from the group consisting of alumina and mullite, wherein a particle size of the bubble material in the first layer is smaller than a particle size of the bubble material in the additional layer.

2. The ceramic material as claimed in claim 1, wherein viscosity of the ceramic slurry used in forming the first layer is higher than viscosity of the ceramic slurry used in forming the additional layer.

3. The ceramic material as claimed in claim 1, wherein the particle size of the bubble material in the first layer is approximately half the particle size of the bubble material in the additional layer.

4. The ceramic material as claimed in claim 3, wherein the particle size of the bubble material in the first layer is substantially within the range of 0.25 mm –0.50 mm diameter.

5. The ceramic material as claimed in claim 3, wherein the particle size of the bubble material in said additional layer is substantially within the range of 0.50 mm –1.00 mm diameter.

6. The ceramic material as claimed in claim 1, wherein the slurry for the first layer comprises a binder comprising a colloidal silica solvent containing silica and a filler consisting of zirconium silicate flour, and the slurry for said additional layer comprises a binder comprising hydrolyzed ethyl silicate, isopropanol solvent containing silica, and a filler consisting of zirconium silicate flour.

* * * * *